US005592798A

United States Patent [19]

Friesen et al.

[11] Patent Number: 5,592,798

[45] Date of Patent: Jan. 14, 1997

[54] SPACER FOR GLASS BLOCKS

[75] Inventors: Jed C. Friesen, Suite 205, 98 Tenth Street, New Westminster, British Columbia, V3M 6L8; Bohumir Cervenka, Vancouver, both of Canada

[73] Assignee: Jed C. Friesen, British Columbia, Canada

[21] Appl. No.: 427,842

[22] Filed: Apr. 26, 1995

[51] Int. Cl.[6] ..... E04G 21/16

[52] U.S. Cl. ..... 52/308; 52/100; 52/442

[58] Field of Search ..... 52/306, 308, 442, 52/565, 98, 100, 426, 562, 307; 249/41, 214; 33/518, 526, 613, 626, 645

[56] References Cited

U.S. PATENT DOCUMENTS

| | | | |
|---|---|---|---|
| 2,797,495 | 7/1957 | Walston | 33/518 |
| 4,114,337 | 9/1978 | Neuhardt . | |
| 4,774,793 | 10/1988 | Mayer . | |
| 5,119,567 | 6/1992 | Fox . | |
| 5,146,725 | 9/1992 | Bruce et al. . | |
| 5,191,718 | 3/1993 | Fox . | |
| 5,224,314 | 7/1993 | Chen . | |

*Primary Examiner*—Michael Safavi

[57] ABSTRACT

A spacer for use in forming a wall of glass blocks which includes a pair of parallel elongated first arms, a pair of parallel elongated second arms, with each of the second arms being perpendicular to a corresponding one of the first arms so as to form a pair of spaced apart crossed arms. An elongated connecting bar interconnects to the crossed arms a plate positioned parallel to each of said crossed arms. A frangible coupling affixes each of the plates to a corresponding one of the crossed arms and an elongated vane element extends out from and across the plates and passes through a notional line through a center of each of the frangible couplings so that a user may grip and twist the vane element so as to impart a torque about the notional line which shears an associated frangible coupling at its joint with an associated one of the crossed arms without imparting any translational force to the spacer.

11 Claims, 4 Drawing Sheets

SPACER FOR GLASS BLOCKS

FIELD

The present invention relates to a spacer for spacing glass blocks in a wall formed from such blocks.

BACKGROUND

There are a variety of different spacers for glass blocks. U.S. Pat. No. 4,114,337 issued to Neuhardt discloses use of a plate located at either end of the spacer and attached to locating arms of the spacer by a frangible connector. Although the plates are a much more reliable means of positioning the spacer since they depend upon the face edge and exterior faces of the wall which are accurately located, removing the plates themselves without dislodging are damaging the joint is difficult. Because the faces and face edges are used to accurately position the spacer, the crossed arms are necessarily positioned close to the face. Thus, there is ⅛ of an inch or less from the crossed arms in which to rework the mortar. Any pieces or splinters left from twisting off a tapered interconnecting member affixing respective plates to the crossed arms will interfere with the proper re-working of the mortar along the joints.

U.S. Pat. No. 5,146,725 issued to Bruce et al. discloses a spacer which is positioned by engagement of a central groove with the central bead of the glass blocks. Since the central beads are irregular and unreliable as a positioning reference, this kind of spacer can not be accurately positioned in all cases.

U.S. Pat. No. 4,774,793 issued to Mayer discloses a spacer for glass block walls or panels which fits into the channel between the two face edges. However, the channels of glass blocks are not fabricated to any standard but can vary significantly from manufacturer to manufacturer. At present there are no less than eight manufacturers selling glass blocks in the United States. Thus, the spacing between blocks using the spacers of Mayer will not always meet the accepted industry standard spacing of ¼ inch.

U.S. Pat. Nos. 5,119,567 and 5,191,718 also disclose the use of locating plates at either end of the spacer. However, it is necessary to straighten wires which are initially bent to hold the spacer members held together by a thin wire tie. Unfortunately, it is not always possible to straighten the wire sufficiently to allow it to be pulled through the spacer members when taking off the latter. The plates are intrusive and their removal often causes movement of the blocks and disturbance of the mortar.

U.S. Pat. No. 5,224,314 issued to Chen discloses circular disks affixed by a frangible connection to crossed locating arms at either end of the spacer. The disks have a radially disposed rectangular elongate twisting bar which serves as a means by which a user can grip the disk and rotate it until the frangible connection shears off. However, the location and size of the twisting bar makes it difficult for a user to grip the bar and to rotate the disk without applying a translational force to the spacer, causing it to move and disrupt the integrity of the joint. Moreover, the frangible connection has a tendency to be difficult to break and to leave splinters when it is removed which extend into the outer area of the mortar.

Accordingly, it is an object of the invention to provide an improved spacer for constructing a wall with glass blocks. It is a further object to provide a spacer with plate that can be easily removed after the wall is formed.

SUMMARY OF THE INVENTION

According to the invention there is provided a spacer for use in forming a wall of glass blocks which includes a pair of parallel elongated first arms, a pair of parallel elongated second arms, with each of the second arms being perpendicular to a corresponding one of the first arms so as to form a pair of spaced apart crossed arms. An elongated connecting bar interconnects to the crossed arms. A plate is positioned parallel to and spaced away from each of said crossed arms. A frangible coupling affixes each of the plates to a corresponding one of the crossed arms and an elongated vane element extends out from and across the plates passing through a notional line through a center of each of the frangible couplings so that a user may grip and twist the vane element so as to impart a torque about the notional line which shears an associated frangible coupling at its joint with an associated one of the crossed arms without imparting any translational force to the spacer.

Preferably the frangible coupling is a tapered interconnecting member having its narrow end joined to an associated one of said crossed arms. A joint between a narrow end of each of the tapered interconnecting members and associated ones of the crossed arms is serrated.

Advantageously, one arm of each of the crossed arms is an I-beam and each of the tapered interconnecting members is joined to a central web of an associated one of the I-beams. The use of an I-beam provides a recess from the outer face of each of the crossed arms within which to join the narrow end of the tapered interconnecting member to respective crossed arms so that any splinters or pieces left from twisting off the plates is recessed within the sides of the I-beam. This feature avoids the splinter or piece from projecting into the area of the joint that is reworked.

The spacer may be injection molded as a single piece.

The distance between the plate members corresponds to a thickness of the wall of glass blocks. An exterior envelope, defined by the arms in cross section, is rectangular.

In another aspect of the invention there is provided a spacer for use in spacing adjacent end surfaces and top and bottom surfaces of glass blocks in forming a mortared wall of such blocks, which includes a first set of crossed arms having an arm for vertical disposition in the wall between the adjacent end surfaces and an arm for horizontal disposition between top and bottom surfaces of adjacent glass blocks. A second set of crossed arms has an arm for vertical disposition in the wall between the adjacent end surfaces and an arm for horizontal disposition between top and bottom surfaces of adjacent glass blocks. The arm for vertical disposition of the first set of crossed arms is thicker than the arm for vertical disposition of the second set of crossed arms so as to position adjacent blocks at a slight angle and allow the formation of a curved wall. A first plate is affixed to but spaced away from an intersection of the first set of crossed arms. A second plate is affixed to but spaced away from an intersection of the second set of crossed arms with the second plate being smaller than the first plate so as to accommodate the concavity of the curved wall. A pair of tapered interconnecting members connect the plates to corresponding ones of the crossed arms wherein a joint between a narrow end of each of the tapered interconnecting members and an associated one of the crossed arms is frangible.

BRIEF DESCRIPTION OF THE DRAWINGS

The novel features believed to characterize the invention are set forth in the appended claims. The invention itself, however, as well as other features and advantages thereof, will be best understood by reference to the detailed description which follows, read in conjunction with the accompanying drawings, wherein:

DETAILED DESCRIPTION WITH REFERENCE TO THE DRAWINGS

Figure 1:
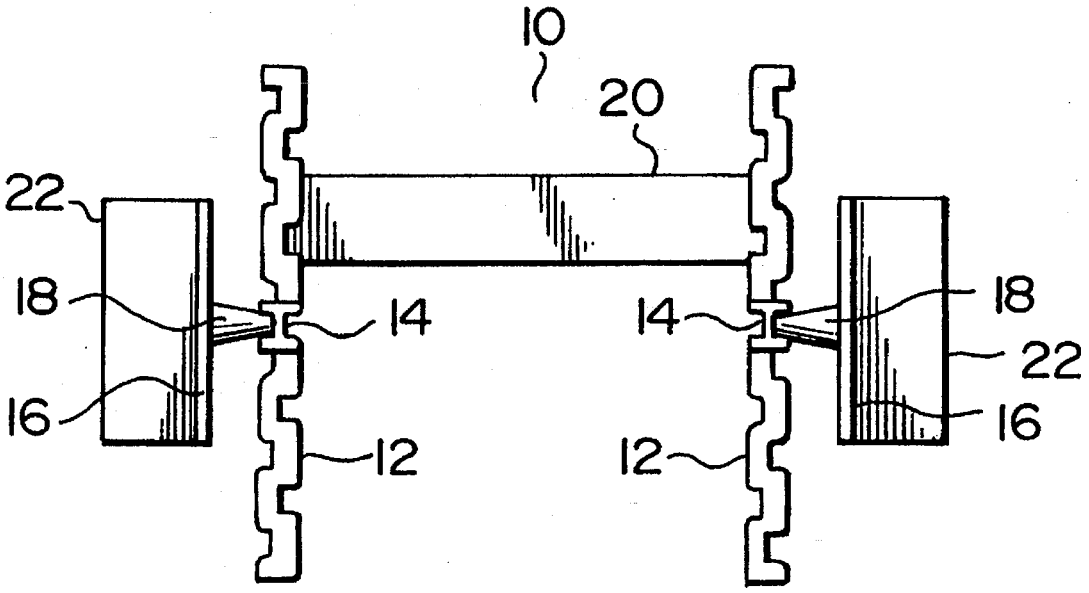
FIG. 1 is top view of the spacer.
Figure 2:
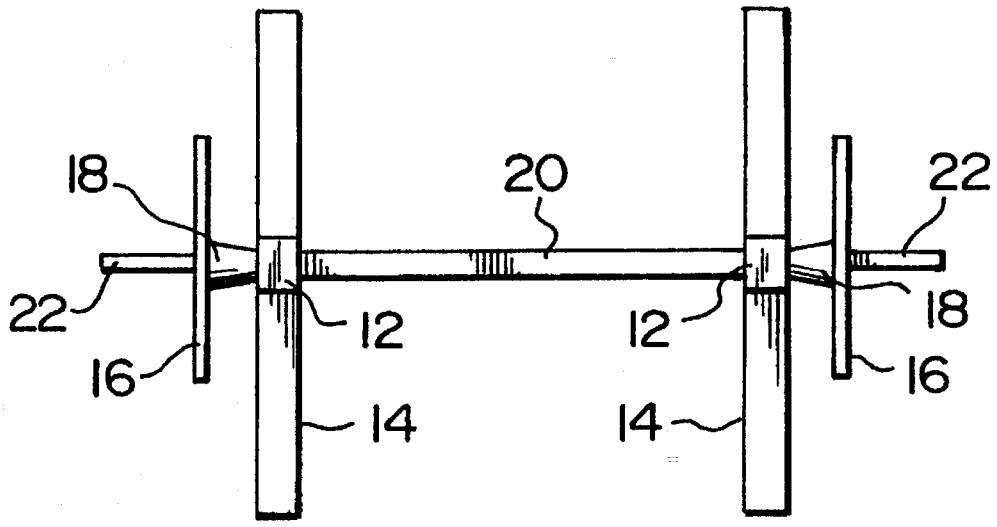
FIG. 2 is a front elevation view of the spacer.
Figure 3:
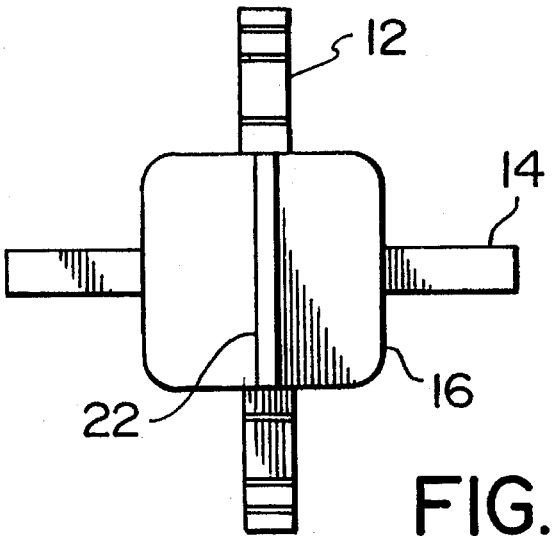
FIG. 3 is an end view of the spacer.

Referring to FIGS. 1, 2 and 3 the glass block spacer 10 consists of parallel serpentine arms 12 interconnected by connecting bar 20. I-beam arms 14 pass perpendicularly through the center of and are affixed to respective serpentine arms 12. Rectangular plates 16 are affixed to respective I-beam arms 14 at their intersection with respective serpentine arms 12 by means of a tapered interconnecting member 18 with the narrow end affixed to a central web of associated I-beam arms 14. A projecting vane element 22 extends across each plate 16 through an axis through the centers of the respective tapered interconnecting member 18.

Figure 4:
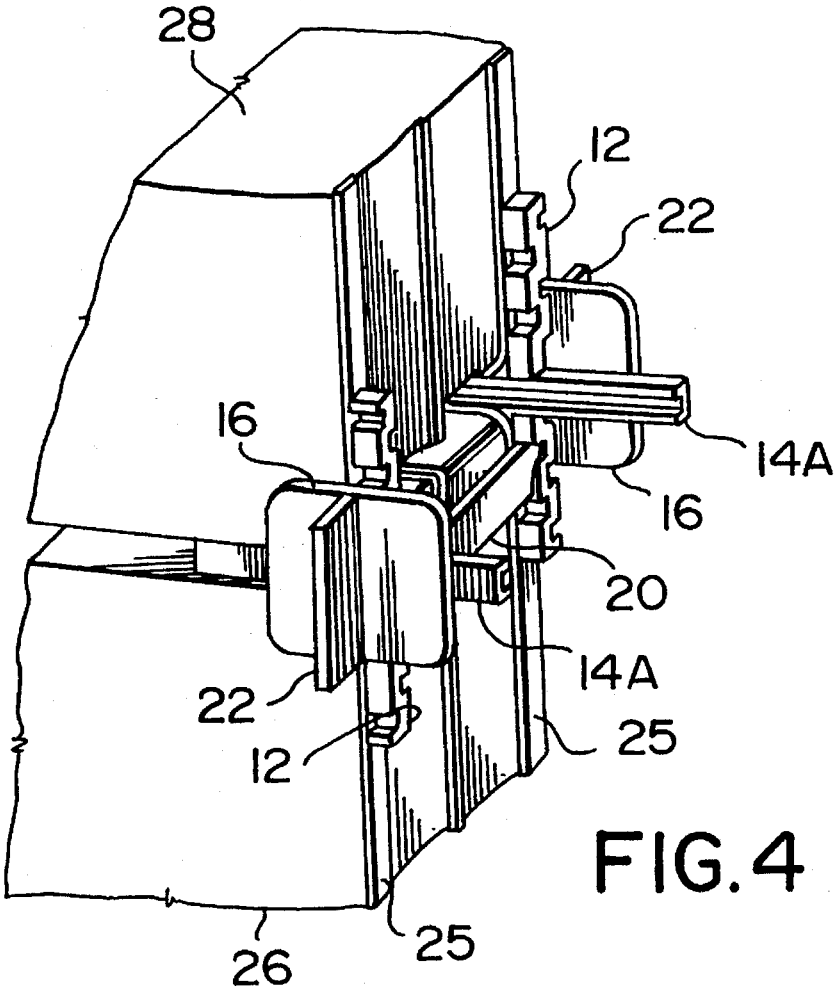
FIG. 4 is perspective view of the spacer positioned at the joint of two glass blocks.
Figure 5:
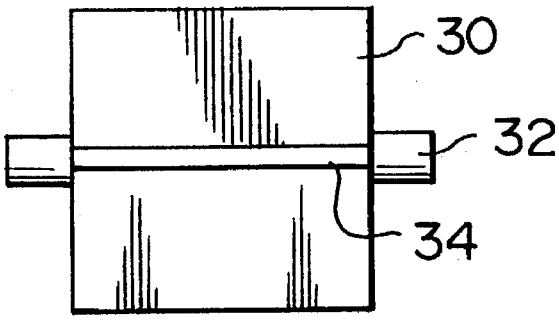
FIG. 5 is an end view of an alternative design of spacer used for forming curved walls.
Figure 6:
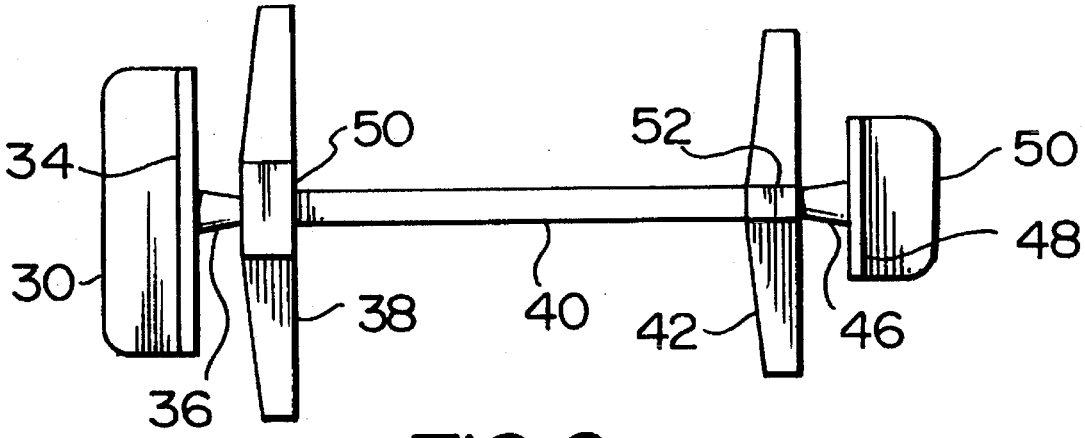
FIG. 6 is top view of the spacer of FIG. 5.
Figure 7:
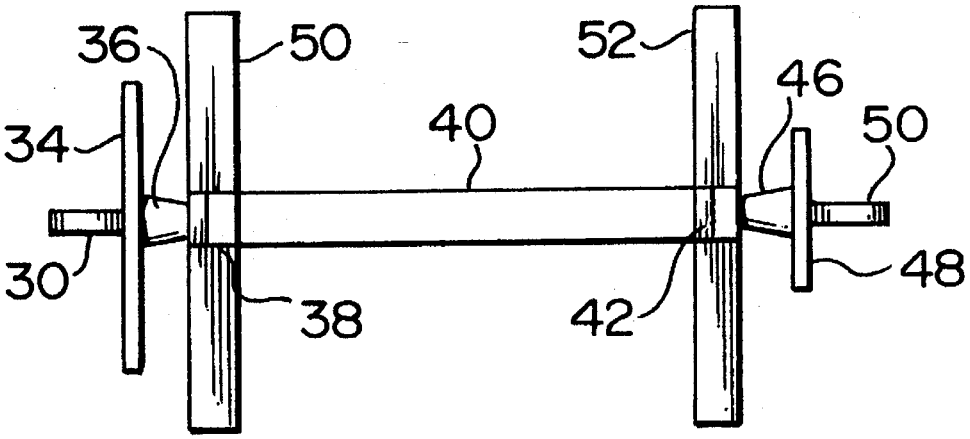
FIG. 7 is a front elevation view of the spacer of FIG. 5.

Referring to FIG. 4 there is shown an alternative spacer with the I-beam arms 14 replaced by U-shaped beam arms 14A. Otherwise the design is the same as that of the spacer shown in FIGS. 1, 2 and 3. The spacer is installed with the U-shaped beam arms 14A resting atop the parallel face edges 25 with the serpentine arms 12 being vertically oriented. Face edges 25 are formed to accurate tolerances regardless of the manufacturer. The beam arms 14A are positioned between the blocks 26 and 28. The plates 16 abut the outside of the blocks so as to maintain the alignment of the spacer 10. The arms 12 and 14 separate the blocks from one another based upon contact with face edges 25 which are accurately formed. Although not shown, mortar is applied to the blocks along all of the joints. Once the wall is complete and before the mortar is set, the plates 16 are removed by gripping the vane element 22 and twisting about tapered interconnecting member 18 until the joint between the latter and arm 14A breaks. Plate 16, vane element 22 and tapered interconnecting member 18 can then be removed and the remaining portion of spacer 10 reworked with mortar. Because vane element 22 extends across plate 16 in line with tapered interconnecting member 18, an even torque about interconnecting member 18 is applied thereby avoiding the tendency of moving the spacer 10 and glass blocks 26 and 28 and disturbing the joint. Often splinters of material are left protruding from arms 14 left from tapered interconnecting member 18. Such splinters usually extend out into the joint area where reworking is required and disturb such reworking. They can not often be effectively covered by the required subsequent joint filling operation. An applicator must then perform additional steps to eliminate the splinter. One way of reducing the problem of splinters is to utilize I-beam arms 14 or U-shaped beam arms 14A so that the joint is recessed into the arms 14, 14A thereby minimizing any protrusion.

The I-beam construction of arms 14 also is important in the injection molding of spacer 10 since the latter process leaves the mold hot. As it cools, if the shape is not symmetrical, there is a tendency for the shape of the arm 14 to deform. Such deformation can also occur when mortared into the joint due to the pressure of the wall and the heat generated by the curing of the mortar. The resultant bending of the arms 14, if they are U-shaped in cross-section, can lead to instability.

Figure 8:
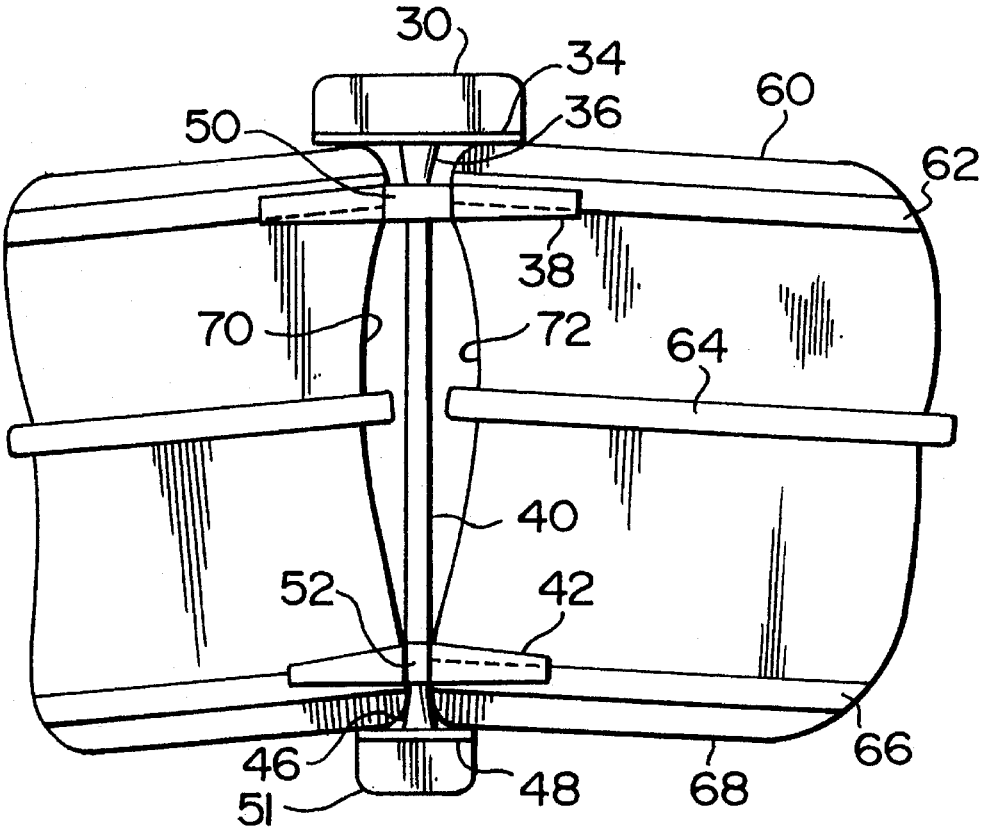
FIG. 8 is a top view of the spacer of FIG. 5 used in forming a curved wall.

Referring to FIGS. 5, 6, 7 and 8 there is shown a spacer for curved walls. In this case arms 38 and 42 are perpendicular to respective arms 50 and 52. with arm 50 being thicker than arm 52 and arm 38 being longer than arm 42. Plate 34 is larger than plate 48. Outwardly projecting vane elements 30 and 51 extend across respective plates 34 and 48. Tapered interconnecting members 36 and 46 connect respective plates 34 and 48 to arms 50 and 52, respectively. As shown in FIG. 8, the thicker arm 50 results in a wider spacing between glass blocks at that position than at the position of thinner arm 52. The smaller plate 48 accommodates the slight concavity of the wall surface 68. A larger plate 34 is permitted by the convex curvature of wall surface 60. Arms 38 and 42 are tapered so as to follow the direction of metal strips 62 and 66. In this case, connecting bar 40 is aligned with the tapered interconnecting members 36 and 46.

Figure 9:
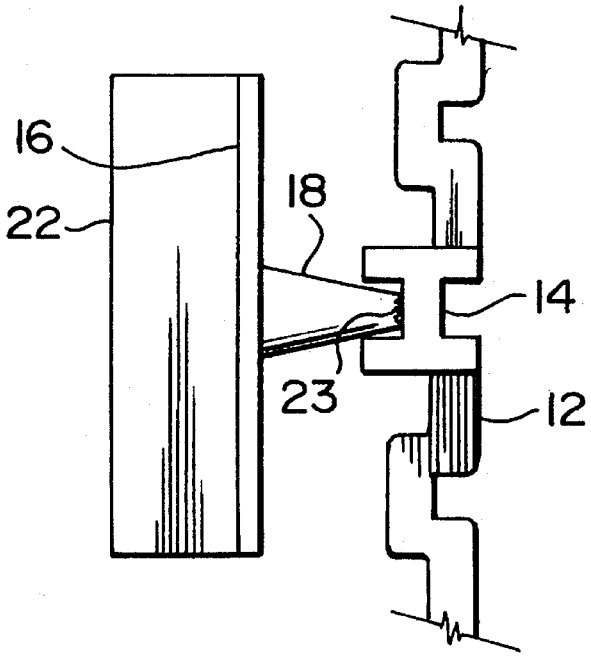
FIG. 9 is a variant of the spacer showing the tapered interconnecting member having a serrated joint to the crossed arms.

Referring to FIG. 9 there is shown an alternative construction of the tapered interconnecting member 18 in which joint 23 is serrated so that upon twisting plate 16 the joint 23 breaks without leaving any splinters or protruding portions of tapered interconnecting member 18. It can be seen that any splinter that may be left would be within the recess of I-beam arm 14.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A spacer for use in forming a wall of glass blocks, comprising:

(a) a pair of parallel elongated first arms;

(b) a pair of parallel elongated second arms, each of said second arms being perpendicular to a corresponding one of said first arms so as to form a pair of spaced apart crossed arms positioned to rest on edge surfaces of a glass block bounding the exterior wall forming surfaces thereof;

(c) an elongated connecting bar interconnecting said crossed arms;

(d) a pair of plates positioned parallel to each of said crossed arms and spaced apart a distance so as to be able to lie on either side of said glass blocks;

(e) a frangible coupling affixing each of said plates to a corresponding one of said crossed arms having a plurality of holes at its junction with said one crossed arm so as to weaken the joint and permit breaking at the joint without splintering; and (f) an elongated vane element extending out from and across said plates and passing through a notional line through a center of each of said frangible couplings so that a user may grip and twist said vane element so as to impart a torque about said notional line which shears an associated frangible coupling at its joint with an associated one of said crossed arms without imparting any translational force to said spacer.

2. A spacer according to claim 1, wherein said frangible coupling is a tapered interconnecting member having its narrow end joined to an associated one of said crossed arms by a serrated joint.

3. A spacer according to claim 2, wherein a tapered interconnecting member is joined to said crossed arm in a recess therein so that upon being sheared any splinters left are substantially contained within the recess.

4. A spacer according to claim 2, wherein one arm of each of said crossed arms is an I-beam and each of said tapered interconnecting members is joined to a central web of an associated one of said I-beams.

5. A spacer according to claim 1, wherein said spacer is injection molded as a single piece.

6. A spacer according to claim 1, wherein an exterior envelope defined by said arms in cross section is rectangular.

7. A spacer for use in spacing adjacent end surfaces and top and bottom surfaces of glass blocks in forming a mortared wall of such blocks, comprising:

(a) a first set of crossed arms having an arm for vertical disposition in said wall between the adjacent end surfaces and an arm for horizontal disposition between top and bottom surfaces of adjacent glass blocks;

(b) a second set of crossed arms having an arm for vertical disposition in said wall between the adjacent end surfaces and an arm for horizontal disposition between top and bottom surfaces of adjacent glass blocks wherein said arm for vertical disposition of said first set of crossed arms is thicker than said arm for vertical disposition of said second set of crossed arms so as to position adjacent blocks at a slight angle and allow the formation of a curved wall;

(c) a first plate affixed to but spaced away from an intersection of said first set of crossed arms;

(d) a second plate affixed to but spaced away from an intersection of said second set of crossed arms and wherein said second plate is smaller than said first plate so as to accommodate the concavity of said curved wall; and (e) a pair of tapered interconnecting members connecting said plates to corresponding ones of said crossed arms wherein a joint between a narrow end of each of said tapered interconnecting members and an associated one of said crossed arms is frangible.

8. A spacer according to claim 7, wherein said joint is serrated.

9. A spacer according to claim 7, each of said arms for vertical disposition of said first and second set of crossed arms is in the shape of an I-beam in cross-section.

10. A spacer according to claim 9, wherein said joints between a narrow end of said tapered interconnecting members and respective arms for vertical disposition is with a central web of said arms.

11. A spacer according to claim 7 including an elongated projecting vane element extending across each of said plates through an axis of said interconnecting members so as to permit a user to twist said plates until the frangible connections are sheared without imparting any translational forces to said spacer and wall.

* * * * *